United States Patent [19]

Orndorff, Jr.

[11] 4,119,051

[45] Oct. 10, 1978

[54] RIGID MOORING ARM QUICK DISCONNECT

[75] Inventor: James Allen Orndorff, Jr., Glen Ellyn, Ill.

[73] Assignee: Chicago Bridge & Iron Company, Oak Brook, Ill.

[21] Appl. No.: 837,689

[22] Filed: Sep. 29, 1977

[51] Int. Cl.[2] ..... B63B 21/56

[52] U.S. Cl. ..... 114/249; 244/161

[58] Field of Search ..... 114/230, 242, 248, 249-252, 114/270 N; 244/161, 135 R; 294/83 R, 83 AB; 213/1 R, 75 R

[56] References Cited

U.S. PATENT DOCUMENTS

| | | | |
|---|---|---|---|
| 3,508,723 | 4/1970 | Warren et al. | 244/161 |
| 3,666,216 | 5/1972 | Nagy et al. | 244/161 |
| 3,737,117 | 6/1973 | Belew | 244/161 |

*Primary Examiner*—Trygve M. Blix
*Assistant Examiner*—Jesus D. Sotelo
*Attorney, Agent, or Firm*—Merriam, Marshall & Bicknell

[57] ABSTRACT

A quick-disconnect locking system for interconnecting sections of a rigid yoke structure comprises a female truncated cone adapted to be connected at its narrow end to one section of a two-piece yoke assembly, and a male truncated cone which is nestable within the female cone and is adapted to be connected at its larger end to the other section of the yoke. When locked, the male and female cones are closely nested and are locked together by a plurality of shear keys which project radially out of the larger end of the male cone into a continuous channel on the inner face of a locking ring attached to the larger end of the female cone. To unlock the assembly, the shear keys are withdrawn radially into the male cone, thus permitting the cone structures to be disengaged. For facilitating nesting of the cones, the smaller end of the male cone is provided with retractable means which engages the female cone and draws the two cones into a closely nested position. Separation of the cones is also aided by the same mechanism which is operated in a reverse direction to push the cones apart.

6 Claims, 6 Drawing Figures

RIGID MOORING ARM QUICK DISCONNECT

This invention relates to a quick-disconnect locking mechanism for interconnecting two rigid yoke structures, such as those used to attach a ship to an offshore mooring station.

BACKGROUND OF THE INVENTION

A problem faced in the operation of offshore oil wells is provision of suitable means for attaching a tanker or other floating vessel to a mooring point during the course of loading or unloading liquid products to or from the vessel. In order to prevent actual contact between the vessel and the mooring point, it is desired that the attachment between the two be made through a rigid yoke assembly or mooring arm such as that disclosed in copending U.S. patent application of Orndorff et al., Ser. No. 805,652, filed June 13, 1977. Such a rigid yoke assembly consists of two sections, one of which is attached to the bow of the vessel, and the other of which is attached to the mooring point.

The design of a suitable quick-disconnect locking means for interconnecting the sections of such a yoke structure is complicated by the large size of the structure, which is required to withstand axial and bending forces of great magnitude, as well as the fact that the floating vessel, being subject to the forces of the wind and waves, is usually in constant motion. Ideally, an interconnect system for such use should provide a rigid joint between the sections of the yoke, such that the structural integrity thereof is maintained; it should have a locking system able to withstand the forces tending to separate the sections; it should be readily disconnected when desired; and it should have a "fail-safe" feature which would prevent separation of the joint in the event of a power failure.

BRIEF DESCRIPTION OF THE INVENTION

The above requirements are met by the quick-disconnect system of the present invention, which, briefly described, comprises a female truncated cone adapted to be connected at its narrow end to one section of a two-piece yoke assembly, and a male truncated cone which is nestable within the female cone and is adapted to be connected at its larger end to the other section of the yoke. When locked, the male and female cones are closely nested and are locked together by a plurality of shear keys which project radially out of the larger end of the male cone into a continuous channel on the inner face of a locking ring attached to the larger end of the female cone. To unlock the assembly, the shear keys are withdrawn radially into the male cone, thus permitting the cone structures to be disengaged. For facilitating nesting of the cones, the smaller end of the male cone is provided with retractable means which engages the female cone and draws the two cones into a closely nested position. Separation of the cones is also aided by the same mechanism which is operated in a reverse direction to push the cones apart.

DESCRIPTION OF THE DRAWINGS

The invention will be better understood from the following detailed description thereof, taken in conjunction with the accompanying drawings, in which.

DETAILED DESCRIPTION

Figure 2:
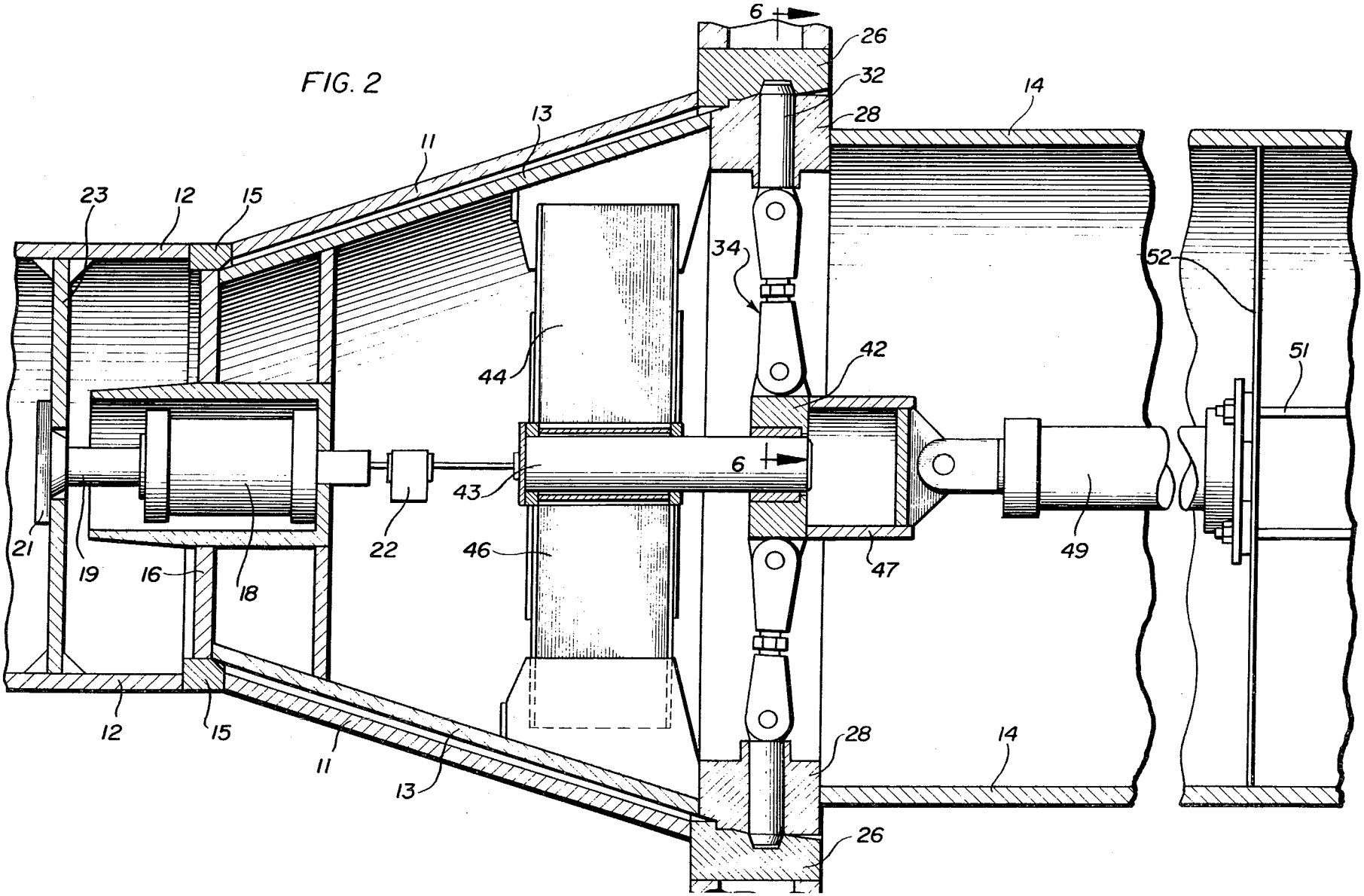
FIG. 2 is a similar view of the female and male cones in a fully nested and locked condition.
Figure 3:
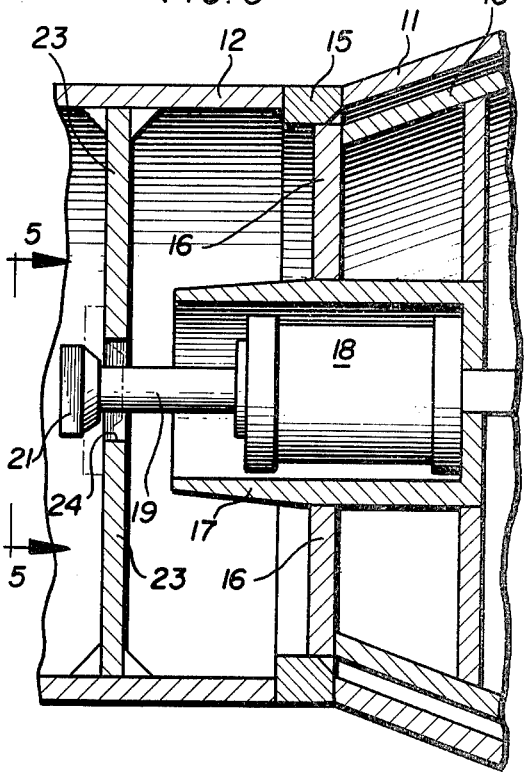
FIG. 3 is a detail in section of the means for drawing the two cones together during the nesting procedure.
Figure 4:
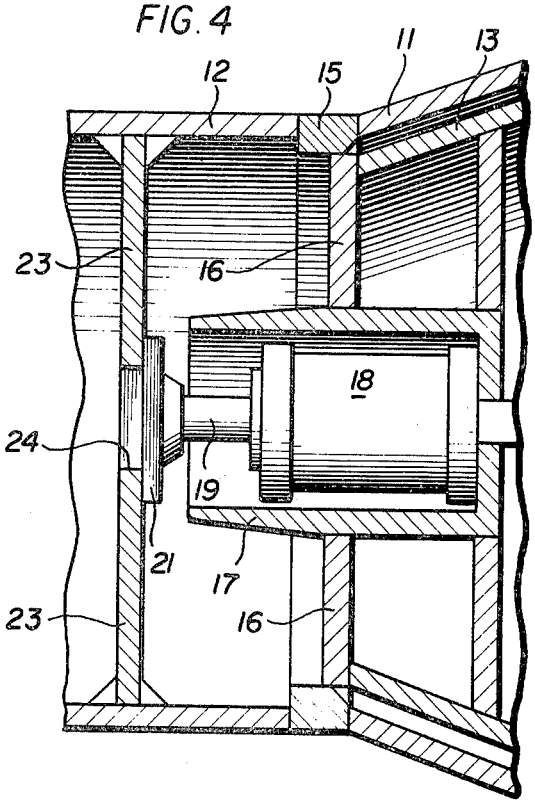
FIG. 4 is a similar view of the same means being used to separate the cones after they are unlocked.

As shown in the drawings, the locking system of the invention consists of two cooperating sections, namely, a truncated female cone 11 having its smaller end attached to a yoke section 12, the other end of which is connected to a mooring station, not shown. Cooperating with female cone 11 is male cone 13 which is similarly truncated and which has dimensions such that it can nest snugly within female cone 11, as shown in FIG. 2. The larger end of cone 13 is connected to one end of yoke section 14, the other end of which is attached to a floating vessel, not shown.

Situated at the point of juncture between yoke section 12 and female cone 11 is a positioning ring 15 having an internal diameter of a size which snugly accepts positioning plate 16 covering the narrow end of male cone 13. Centrally located in positioning plate 16 and extending toward yoke 12 is bullnose 17 containing a bullnose hydraulic cylinder 18 including a rod 19 (FIG. 2) which can be extended or retracted by operation of cylinder 18 in conventional fashion. To the free end of rod 19 is attached a rectangular locking wing 21 which can be rotated through 90° by rotation of rod 19 produced by rotary actuator 22.

Figure 5:
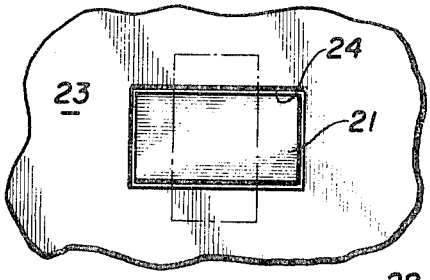
FIG. 5 is a detail along the line 5—5 of FIG. 3 showing the operation of the retractable rod used for nesting and separating the cones.
Figure 6:
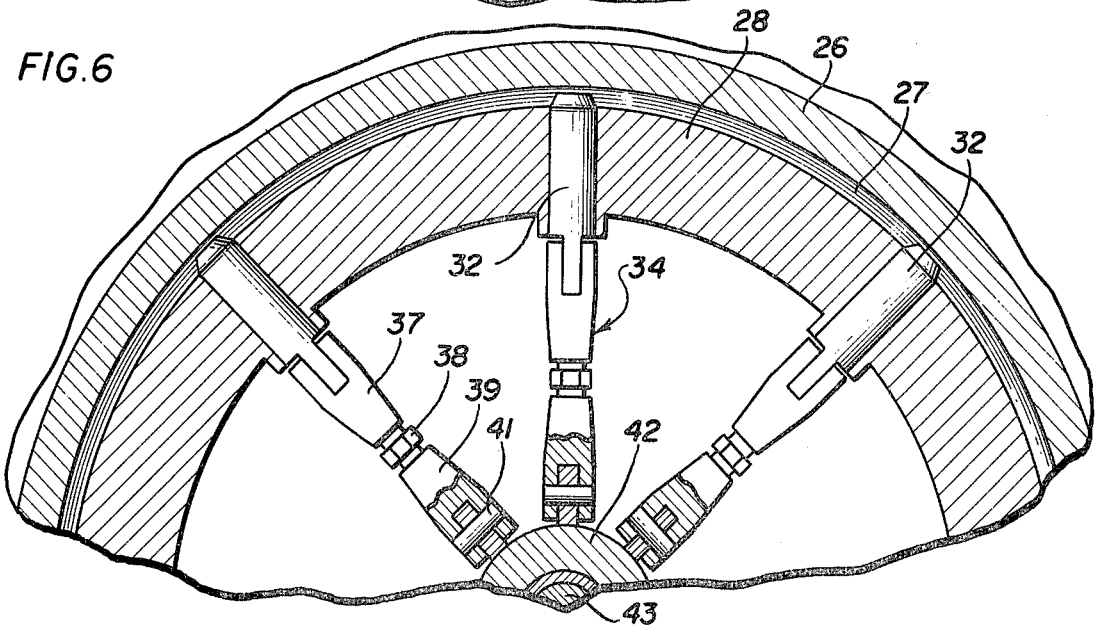
FIG. 6 is a sectional view along the lines 6—6 of FIG. 2 showing the construction of the means used to activate the shear keys.

Located within yoke 12, at a distance from the end thereof within the reach of the extension of rod 19, is a locking plate 23 having a central rectangular aperture 24 (see FIG. 5). Aperture 24 has a size which is somewhat larger than that of rectangular locking wing 21 attached to the end of rod 19, and is so oriented (e.g., with its longer dimension extending horizontally) so that when wing 21 is properly positioned by rotary actuator 22, the wing will pass through aperture 24 to the far side of locking plate 23 when rod 19 is stroked in a forward direction by cylinder 18. Having passed through plate 23, wing 21 can be rotated through approximately 90° by actuator 22 so that it now spans aperture 24, as shown in phantom lines in FIG. 5.

Encircling the larger end of female cone 11 is a female slot ring 26, the inner face of which is provided with a continuous circumferential slot 27 and a contour which is adapted to mate with the outer surface of male shear key ring 28 attached to and encircling the larger end of male cone 13 (FIG. 2). Mating of male and female rings 28 and 26 is facilitated by outwardly extending ridge 29 on male ring 28 which abuts a similarly shaped shoulder 31 on the inner surface of female ring 26 when the cones 11 and 13 are fully nested.

Circumferentially spaced around male ring 28 are a plurality (8 in the present embodiment, although the number can vary to meet particular requirements) of shear keys 32, suitably cylindrical or other rods, the ends of which can be provided with transverse extensions if necessary to increase the shear strength thereof. Shear keys 32 are reciprocable within radially extending bores 33 in male ring 28, from an unlocked position (FIG. 1), in which the outer end of each shear key is at or below the outer surface of male ring 28, to an extended or locked position (FIG. 2), in which the shear keys protrude into slot 27, thereby locking rings 26 and 28, and cones 11 and 13 connected thereto. Shear keys 32 can be cylindrical rods, the outer ends of which can be provided with transverse members if necessary to increase the shear strength thereof.

The inner end of each shear key 32 is pivotally connected by a connecting rod assembly 34 comprising clevis pin 36, clevis 37, turnbuckle 38, clevis 39, and clevis pin 41 to central ring 42 which is apertured to receive and ride on longitudinally extending pilot shaft 43, which in turn is located at the axis of male cone 13 by a suitable member of radial arms, e.g., 44 and 46. Attached to central ring 42 by means which provides clearance for the free end of shaft 43 to protrude through central ring 42, such as a section of pipe 47, is the reciprocable rod 48 of shear key hydraulic cylinder 49, the far end of which is attached by suitable brackets and plates 51 and 52 to yoke 14.

Figure 1:
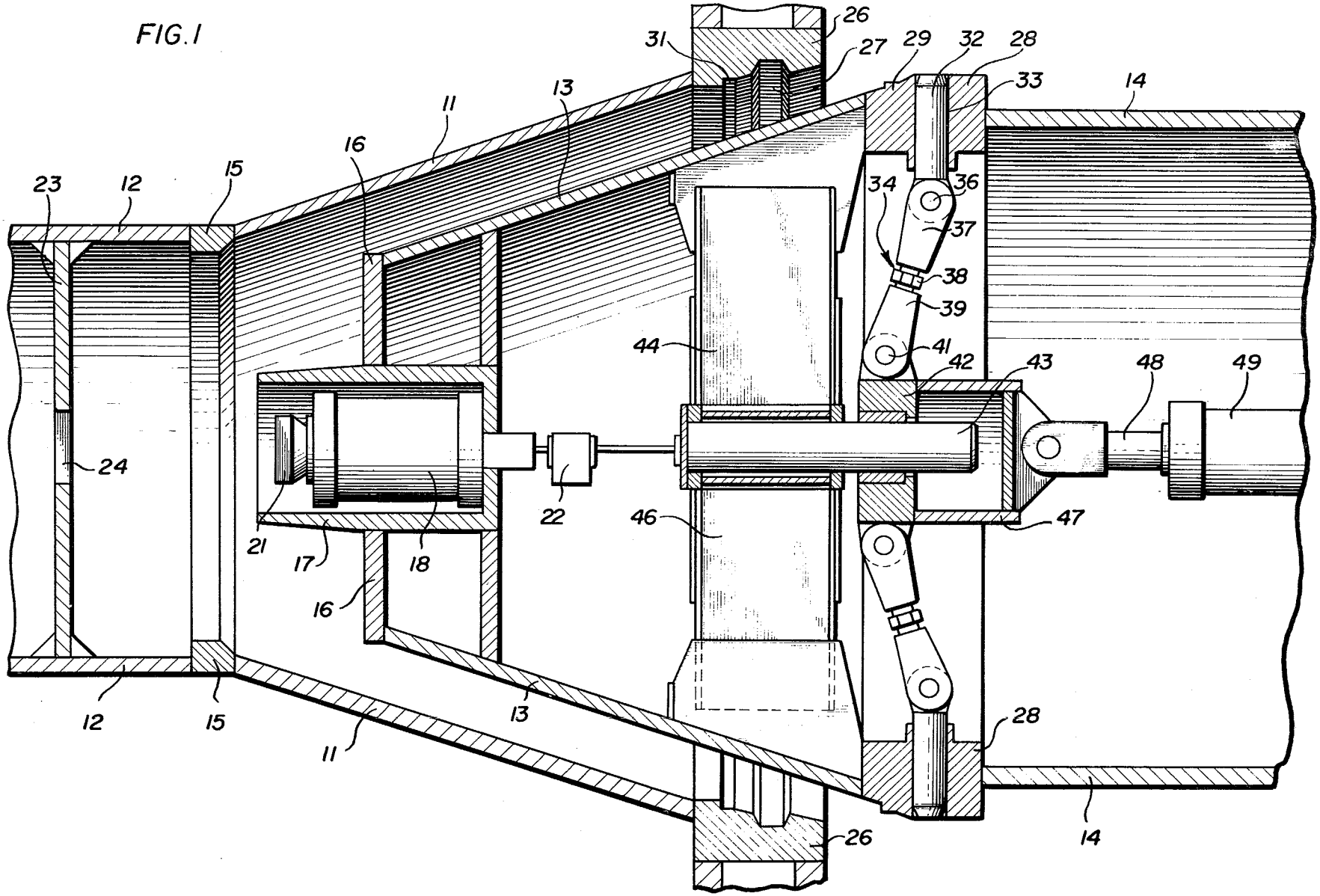
FIG. 1 is a vertical sectional view of an embodiment of the invention, showing the male and female cones in a partially nested but unlocked condition.

By means of turnbuckle 38 the effective length between clevis pins 36 and 41 can be so adjusted such that when central ring 42 is stroked forward by extension of rod 48 of shear key hydraulic cylinder 49, shear keys 32 are retracted sufficiently to permit disengagement of male and female rings 28 and 26, as shown in FIG. 1. As rod 48 is retracted, the connecting rod assemblies 34 cause shear keys 32 to extend out of male ring 28 and to engage slot 27 in female ring 26, thus interlocking cones 11 and 13.

As a "fail-safe" feature which will prevent unintended unlocking of the disconnect system in the event of a power failure, in the fully locked position, with rod 48 fully retracted, central ring 42 is positioned slightly beyond dead center, i.e., the position at which the outward movement of shear keys 32 is at its maximum, the depth of slot 27 in female ring 26 being sufficient to accommodate the maximum extension of the keys at dead center. In the fully locked condition shown in FIG. 2 any external inward force exerted on shear keys 32 tends to force central ring 42 to move toward hydraulic cylinder 49, such movement being prevented by reason of the fact that rod 48 is fully retracted. Accordingly, unintentional retraction of shear keys 32 in the locked structure is inhibited even when hydraulic cylinder 49 is de-energized. It is also desirable to provide the outer ends of shear keys 32 with tapered or conical surfaces as shown, and to taper the walls of slot 27 in ring 26 to match the tapered surfaces. During a quick-disconnect operation, any horizontal force applied to the keys 32 produces an inwardly directed radial component which helps to overcome the frictional force between each shear key 32 and its associated bore 33. Similarly, in the locked condition of the structure, any horizontal force exerted on yoke sections 12 and 14 produces an inwardly directed component on each shear key which tends to maintain the locked condition shown in FIG. 2.

The operation of the invention proceeds as follows. Using any appropriate means, suitably that shown in copending application Ser. No. 805,652, filed June 13, 1977, male cone 13 is caused to enter female cone 11 until it reaches a partially nested position similar to that shown in FIG. 1. When nesting has progressed to an extent within the reach of rod 19 of bullnose cylinder 18, locking wing 21, suitably oriented by rotary actuator 22, is caused to pass through aperture 24 in locking plate 23. Locking wing 21 is then rotated 90° by rotary actuator 22, causing it to span the sides of aperture 24. Retraction of rod 19 then causes male cone 13 to become fully nested within female cone 11 with ridge 29 on male ring 28 abutting shoulder 31 on female ring 26 and with positioning plate 16 within positioning ring 15 at the smaller end of female cone 11. At this time, rod 48 of shear key hydraulic cylinder 49, which had been stroked forward to withdraw shear keys 32 in male ring 28, is retracted to cause the keys to protrude into slot 27 in female ring 26, achieving a fully locked structure as shown in FIG. 2.

To unlock the structure, locking wing 21 is rotated by rotary actuator 22 to permit it to be withdrawn by rod 19 of bullnose cylinder 18 through aperture 24 in locking plate 23. Rod 48 of shear key hydraulic cylinder 49 is stroked forward causing shear keys 32 to be withdrawn into male ring 28. Disengagement of cones 11 and 13 is then achieved by rotating locking wing 21 and stroking rod 19 of bullnose cylinder 18 forward to bear against the near surface of locking plate 23, pushing the cones apart and permitting further disengagement to be readily effected.

The foregoing detailed description has been given for clearness of understanding only, and no unnecessary limitation should be understood therefrom as modifications will be obvious to those skilled in the art.

What is claimed is:

1. A locking system for joining two rigid yoke sections comprising:

a female truncated cone adapted to be connected at its smaller end to one of said yoke sections;

an annular ring attached to the circumference of said female cone at its larger end, said ring being provided on its inner face with a continuous circumferential slot;

a male truncated cone adapted to be connected at its larger end to the other of said yoke structures, said male cone being adapted to nest within said female cone;

a plurality of retractable shear keys circumferentially spaced around the larger end of said male cone and adapted to extend radially outwardly therefrom, said keys being positioned to enter said circumferential slot in said annular ring when said first and second cones are nested, whereby said cones are locked against axial displacement;

means for extending and retracting said shear keys; and longitudinally reciprocable means attached to one of said cones for engaging the other of said cones when said cones are axially aligned in close proximity, said means being operable in one direction to draw said cones into nested relationship and in the opposite direction to separate said cones.

2. A locking system in accordance with claim 1 in which said means for extending and retracting said shear keys includes an axially mounted elongated pilot shaft;

a central ring encircling said pilot shaft and slidable thereon;

a plurality of connecting rods circumferentially spaced about said ring, one end of each rod being pivotally connected to said ring and the other end being pivotally connected to one of said shear keys; and means connected to said ring for reciprocating said ring along said pilot shaft from a first locked position in which said shear keys extend above the surface of said male cone to a second, unlocked position in which said shear keys are retracted.

3. A locking system in accordance with claim 2 in which said means for reciprocating said central ring comprises a hydraulic cylinder having an extendable and retractable rod connected to said ring.

4. The locking system of claim 3 wherein, in the locked position of said shear keys, said rod is fully retracted, and said central ring has passed the dead center position of the connecting rods attached thereto, whereby inward movement of said shear keys resulting from an external inward force applied thereto is inhibited by said rod.

5. The locking system of claim 2 including a second annular ring attached to the circumference of said male cone, said second ring being provided with a plurality of radial bores, each of which encloses one of said shear keys.

6. The locking system of claim 5 in which the outer end of each shear key has a tapered surface and the walls of said circumferential slot are correspondingly tapered to receive said keys.

* * * * *